US005136990A

United States Patent [19]

Motoyama et al.

[11] Patent Number: 5,136,990

[45] Date of Patent: Aug. 11, 1992

[54] FUEL INJECTION SYSTEM INCLUDING SUPPLEMENTAL FUEL INJECTOR

[75] Inventors: Yu Motoyama; Toshikazu Ozawa; Junichi Kaku, all of Iwata, Japan

[73] Assignee: Yamaha Hatsudoki Kabushiki Kaisha, Iwata, Japan

[21] Appl. No.: 591,957

[22] Filed: Oct. 2, 1990

[30] Foreign Application Priority Data

Oct. 2, 1989 [JP] Japan ..... 1-257459

[51] Int. Cl.[5] ..... 123 73 A; F02B 33/04

[52] U.S. Cl. ..... 123/73 C

[58] Field of Search ..... 123/73 A, 73 AD, 73 C, 123/73 R, 73 B, 304

[56] References Cited

U.S. PATENT DOCUMENTS

| | | | |
|---|---|---|---|
| 4,446,833 | 5/1984 | Matsushita et al. | 123/73 C |
| 4,625,688 | 12/1986 | Takayasu | 123/73 C |
| 4,671,220 | 6/1987 | Inoue et al. | 123/73 A |
| 4,700,671 | 10/1987 | Matsushita | 123/73 R |
| 4,770,136 | 9/1988 | Newman | 123/73 A |
| 4,777,913 | 10/1988 | Staerlz | 123/73 A |
| 4,779,581 | 10/1988 | Maier | 123/73 A |

*Primary Examiner*—Andrew M. Dolinar
*Assistant Examiner*—M. Macy
*Attorney, Agent, or Firm*—Ernest A. Beutler

[57] ABSTRACT

A fuel injection system for a two cycle crankcase compression internal combustion engine including a first injector that supplies fuel directly to the combustion chamber of the engine. An induction system is provided for inducting air into the crankcase chamber of the engine and in a multiple cylinder engine this includes a manifold having a single inlet. A throttle body having a throttle valve controls the flow of air through the inlet and a second fuel injector sprays fuel into the throttle body upstream of the throttle valve and against the throttle valve in certain positions of the throttle valve. In accordance with one disclosed embodiment of the invention, the second fuel injector supplies the fuel requirements for maximum power while the first fuel injector supplies the fuel requirements for low and mid range performance, but does not have adequate capacity to supply all of the fuel for high range performance.

40 Claims, 7 Drawing Sheets

FUEL INJECTION SYSTEM INCLUDING SUPPLEMENTAL FUEL INJECTOR

BACKGROUND OF THE INVENTION

This invention relates to a fuel injection system and more particularly to a fuel injection system including a sub injector and an improved location and orientation for such a sub injector.

The use of direct fuel injection in two cycle crankcase compression internal combustion engines is realized as a way in which the emissions and economy of such engines can be controlled. However, it has been found that if all of the fuel for the engine running is injected directly into the cylinder, that certain problems may arise. Specifically, the crankcase and piston may not be adequately cooled under high speed high load running conditions. Normally, fuel is introduced in a two cycle crankcase compression engine through the crankcase and this fuel in the crankcase and its vaporization tends to cool the lower end of the engine and the underside of the piston. However, if all of the fuel is directly injected, then this cooling does not result and certain overheating problems may be encountered.

Also, the use of a single fuel injector and direct fuel injection has been found not to provide the adequate control for the fuel as may be desired under some conditions. That is, if a single, direct fuel injector is employed, it may not be possible to provide the desired fuel control and maximum power output.

To offset the deficiencies as aforenoted, it has been proposed to provide an arrangement wherein a sub injector is provided that will inject fuel into the induction system or crankcase under high speed and high load conditions to supplement the fuel that is supplied directly to the combustion chamber by the main injector. However, the use of such sub injectors gives rise to certain other problems.

Specifically, if a multiple cylinder engine is employed, it is desirable to provide only a single sub injector for all cylinders so as to reduce costs. However, the previously proposed systems have provided some difficulty in insuring adequate mixture distribution from the sub injector to all cylinders under high speed conditions. In addition, since the sub injector normally operates only at high speed conditions, prolonged periods of low speed running can give rise to plugging or clogging of the sub injector. This occurs due to the blow back of gases from the crankcase into the induction system, even when flow controlling check valves are employed.

It is, therefore, a principal object of this invention to provide an improved fuel injection system for a two cycle crankcase compression engine employing a sub injector and wherein a single sub injector can serve multiple cylinders and good mixture distribution is insured.

It is a further object of this invention to provide a sub injector arrangement for the two cycle crankcase compression internal combustion engine wherein the sub injector will be protected from deposits, particularly during the times when it is not injecting fuel.

SUMMARY OF THE INVENTION

This invention is adapted to be embodied in a fuel injection system for a two cycle crankcase compression internal combustion engine that comprises a combustion chamber and a first fuel injection nozzle for spraying fuel directly into the combustion chamber. A crankcase chamber is provided and transfer port means transfer a compressed charge from the crankcase chamber to the combustion chamber. Inlet means are provided for delivering a charge to the crankcase chamber and throttle valve means control the flow through the inlet means.

In accordance with a first feature of the invention, a second fuel injector is provided for injecting fuel against the throttle valve means in at least some positions of the throttle valve means so as to improve mixture distribution.

In accordance with another feature of the invention, a second fuel injector is provided for injecting fuel into the inlet means upstream of the throttle valve means so as to protect the second fuel injector from deposits under low speed running conditions.

DETAILED DESCRIPTION OF THE PREFERRED EMBODIMENTS

Figure 1:
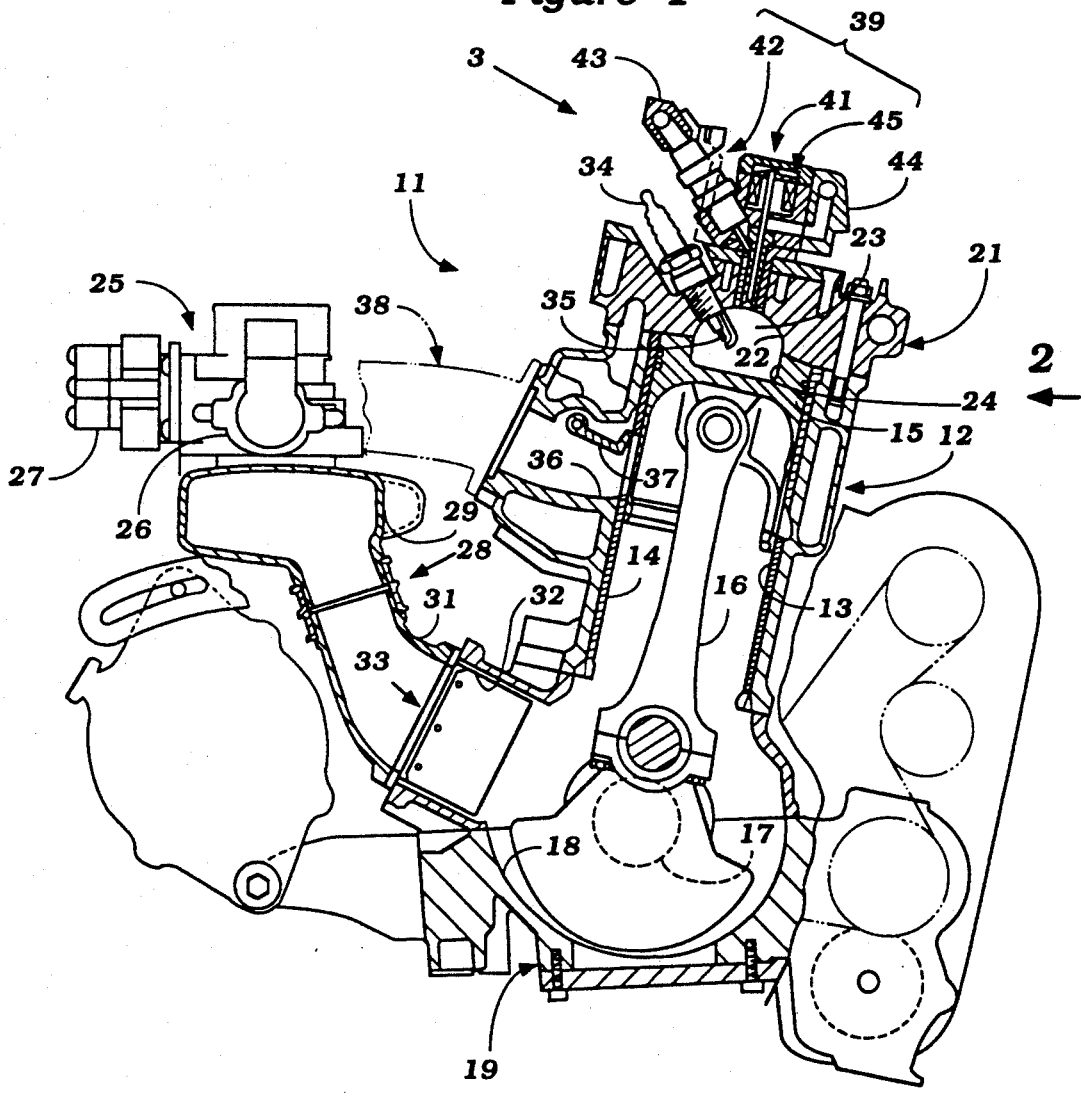
FIG. 1 is a cross sectional view taken through one cylinder of a multiple cylinder, two cycle, crankcase compression engine constructed in accordance with an embodiment of the invention.
Figure 2:
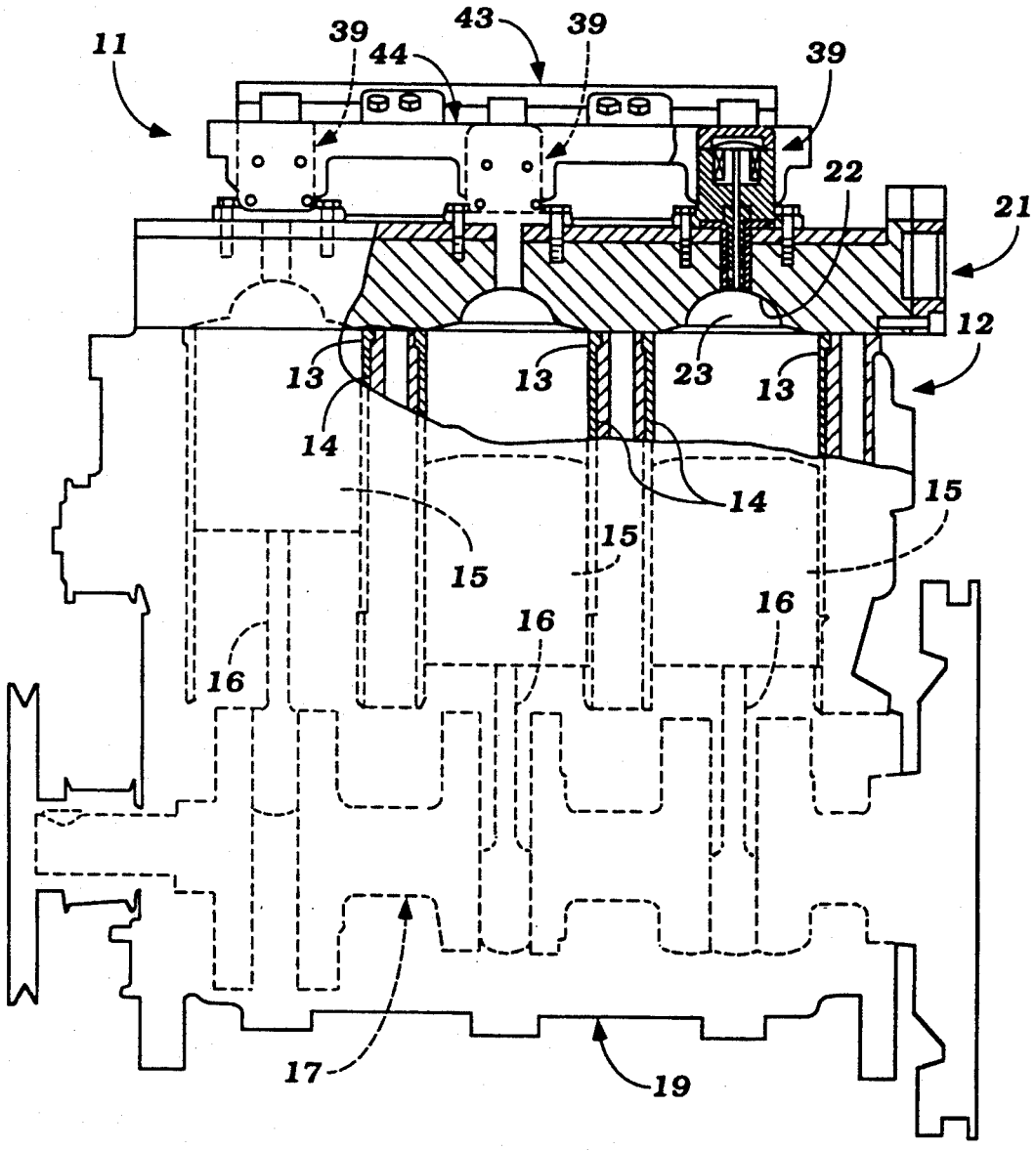
FIG. 2 is a side elevational view, with portions broken away, of the engine and looking generally in the direction of the arrow 2 in FIG. 1.

Referring now in detail to the drawings and initially primarily to FIGS. 1 through 4, a three cylinder, in line, two cycle, crankcase compression, internal combustion engine constructed in accordance with an embodiment of the invention is identified generally by the reference numeral 11. The engine 11 is, as noted, illustrated to be a three cylinder, in line type engine. It is to be understood, however, that the invention may be also employed in conjunction with engines having other numbers of cylinders and other cylinder orientations. In fact, certain features of the invention can be utilized in conjunction with rotary rather than reciprocating type engines and, in addition, some features of the invention may also be employed in engines operating on the four stroke rather than two stroke principle. The invention, however, has particular utility in conjunction with two stroke engines.

The engine 11 is comprised of a cylinder block assembly, indicated generally by the reference numeral 12, in which three aligned cylinder bores 13 are formed by cylinder liner 14 that are received within the cylinder block 12 in a known manner. Pistons 15 are supported for reciprocation within each of the cylinder bores 13 and are connected by means of respective connecting rods 16 to a crankshaft 17 that is journaled for rotation within a crankcase chamber 18 formed by the cylinder block 12 and a crankcase 19 in a known manner.

A cylinder head assembly 21 is affixed to the cylinder block 12 and has individual recesses 22 which cooperate with the piston 15 and cylinder bore 13 to form combustion chambers 23. The heads of the pistons 15 are provided with bowls 24 so as to further form these combustion chambers 23.

Figure 3:
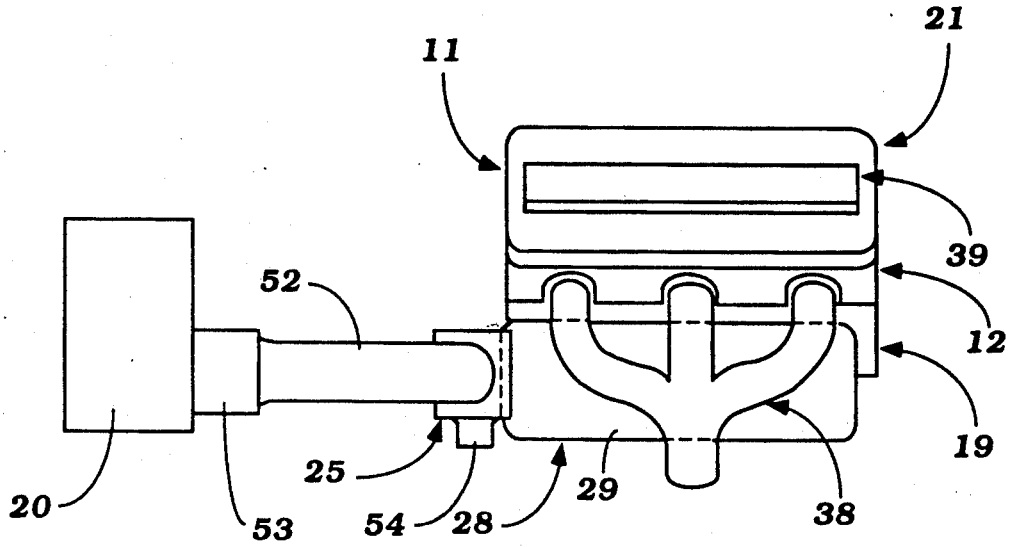
FIG. 3 is a top plan view of the engine.
Figure 4:
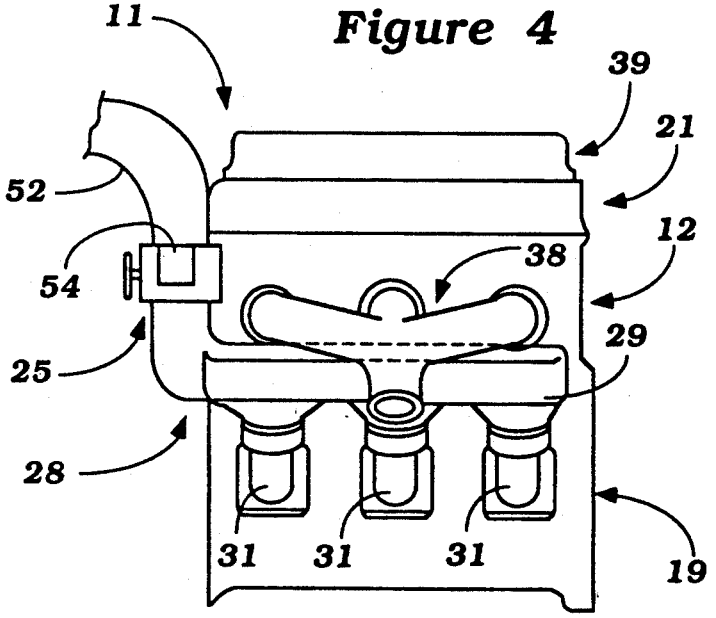
FIG. 4 is a side elevational view of the engine looking in the opposite direction from FIG. 2.

An air charge is delivered to the crankcase chambers 18 associated with each of the cylinder bores 13 by an induction system that includes a throttle body, indicated generally by the reference numeral 25, that receives air from an air cleaner 20 (FIG. 3). This throttle body 25 includes a throttle valve, to be described, which is manually operated and the position of which is sensed by a potentiometer 26 to provide a throttle valve position signal for controlling the fuel injection system to be described. In addition, a sub injector 27 is provided in the throttle body 25 so as to inject additional fuel under certain running conditions as will be described.

The throttle body 25 delivers the air to an induction system, indicated generally by the reference numeral 28, and which includes a plenum chamber 29. The plenum chamber supplies air through manifolds 31 to inlet ports 32 associated with each crankcase chamber 18. These crankcase chambers 18 are sealed from each other, as is typical with two cycle engine practice. A reed type check valve 33 is positioned in each inlet port 32 so as to prevent reverse flow when the charge is being compressed in the crankcase chambers 18 by downward movement of the pistons 15.

The compressed charge is transferred to the combustion chambers 23 through suitable scavenge passages (not shown). This charge is then further compressed in the combustion chambers 23 by the upward movement of the pistons 15 and is fired by a spark plug 34 mounted in the cylinder head 21 with its gap 35 extending into the combustion chamber 23.

The burnt charge is then discharged from the combustion chambers 23 through exhaust ports 36 in which exhaust control valves 37 are provided. The exhaust control valves 37 are operated so as to provide a reduced compression ratio under high speed, high load operating conditions in a suitable manner. The exhaust gases are then discharged to the atmosphere through an exhaust system which includes an exhaust manifold 38.

A fuel air injector unit, indicated generally by the reference numeral 39 is provided and is mounted in the cylinder head assembly 21 for spraying a charge of fuel and air under pressure into the combustion chambers 23. Although the fuel air injectors may be of any known type, they include a housing assembly 41 in which a pair of chambers are provided. Fuel is delivered under pressure to one of these chambers in a manner to be described from a fuel injection nozzle 42 which, in turn, receives fuel from a fuel rail 43. In addition, another of these chambers receives air under pressure from a manifold 44 and this air and the fuel which have been charged into its respective chamber is delivered to the combustion chamber 23 when an injection valve is opened by a solenoid 45. Although this particular type of air fuel injector has been described, the invention may be utilized with a wide variety of types of air fuel injectors or, in that fact, with fuel injectors per se.

Where all of the fuel charge is delivered only to the combustion chamber 23 by the injector 39, it has been found it may be difficult to provide adequate fuel control under all load and speed conditions. In addition, it has been discovered that the piston and other running components of the engine may become overheated, particularly under high load and high speed conditions. This is because there is no evaporation of fuel in the crankcase chambers 18 as with conventional engines which will cool the crankcase, crankshaft and underside of the piston. In accordance with the invention, therefore, the sub injector 27 is provided for spraying additional fuel into the crankcase chambers 18 so as to provide cooling and the necessary fuel for high speed running.

Figure 6:
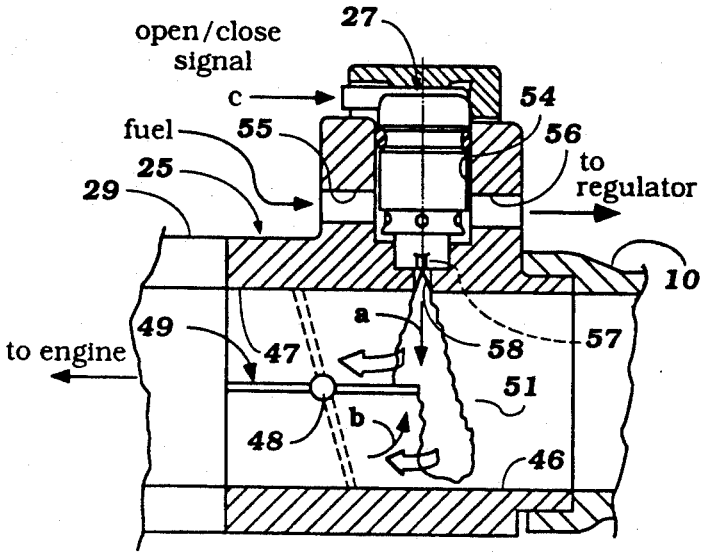
FIG. 6 is a further enlarged cross sectional view showing the relationship of the supplemental injector to the throttle valve.
Figure 5:
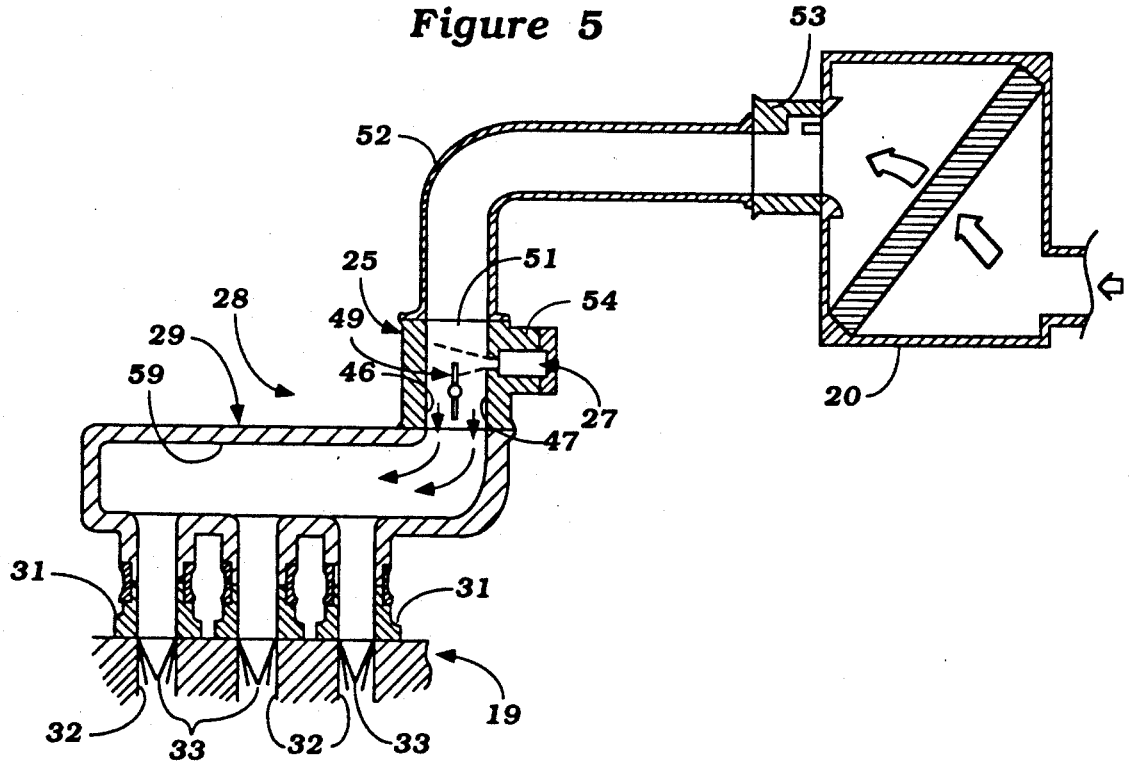
FIG. 5 is an enlarged cross sectional view taken through the air induction system and showing the supplemental fuel injector.
Figure 7:
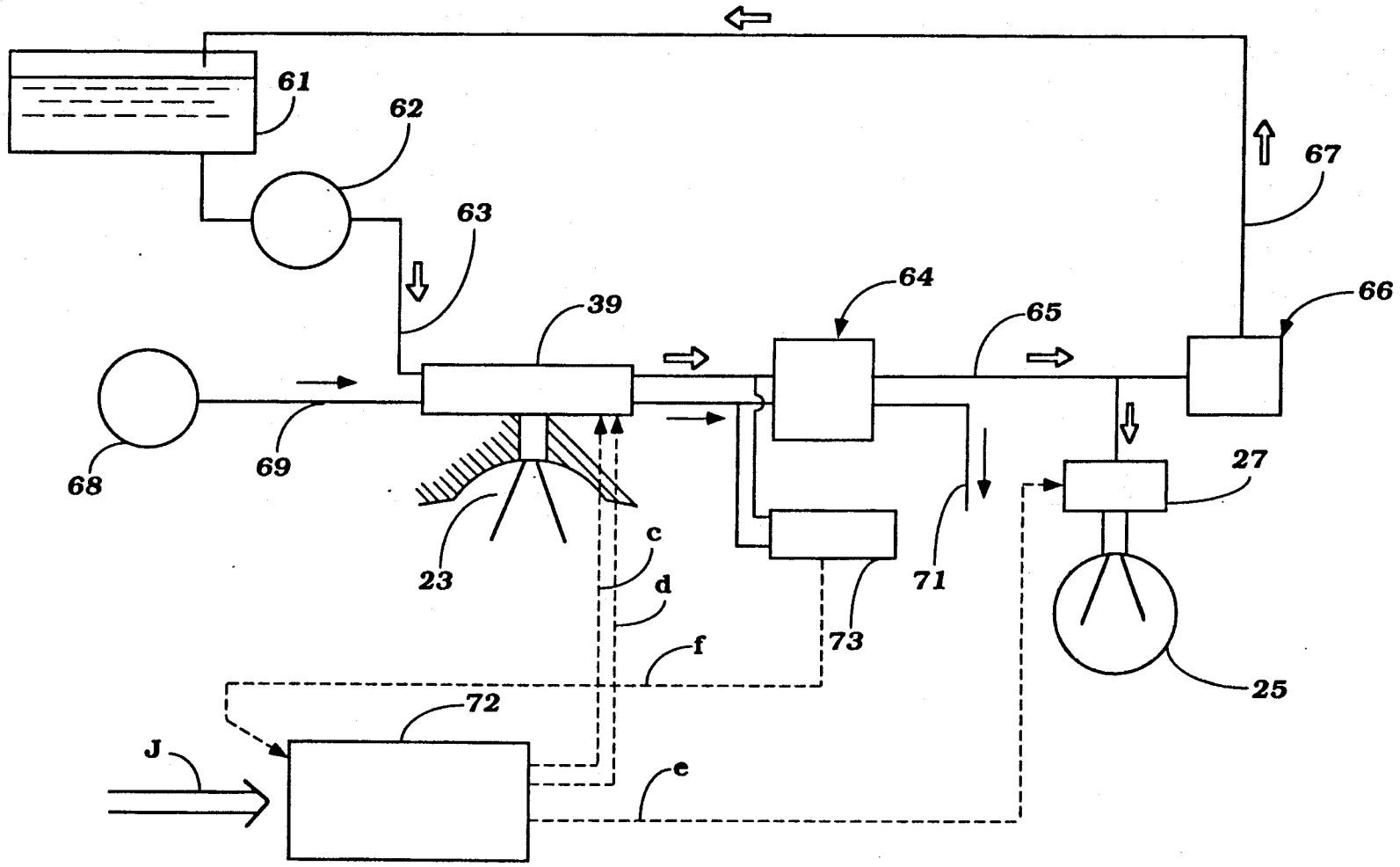
FIG. 7 is a schematic view of the induction system.

The construction and operation of the sub fuel injectors and their relationship to the other components may be best understood by reference to FIGS. 5 and 6 and the overall fuel injection system is shown in FIG. 7.

As may be best seen in FIGS. 5 and 6, the throttle body 25 is provided with a generally cylindrical flow passage that is divided into a first side 46 and a second side 47 by a plane containing the axis of a throttle valve shaft 48 which is journaled in the throttle body 25 in a known manner. A throttle valve 49 is affixed for rotation with the throttle valve shaft 48. The air cleaner 20 supplies air to an inlet section 51 of the throttle body 25 through a conduit 52 in which an air flow detector 5 is provided.

The side of the throttle body 25 having the induction side 47 is provided with an enlarged protuberance 54 that has a bore which receives the sub fuel injector 27. Although the sub fuel injector 27 may be of any type, it is depicted as being of only the fuel injector type and receives fuel under pressure, in a manner to be described, through a conduit 55. The excess fuel is then delivered through a conduit 56. The sub injector 27 has an injection nozzle portion 57 that sprays through a port 58 formed in the throttle body 25. This port 58 is disposed so that when the throttle valve 49 is in its wide open throttle position, as shown in FIGS. 5 and 6, that a portion of the spray from the injection nozzle 57 will impinge upon the throttle valve 49. The remaining fuel will impinge upon the throttle body side 46. This will insure that there will be good fuel air mixture reaching the plenum chamber 29 and specifically the plenum volume 59 (FIG. 5) thereof. As a result, the fuel will be well distributed to the crankcase chambers 18 of the respective cylinders.

When the throttle valve 49 is not in its fully opened position, then the throttle valve will protect the fuel injector 27 and specifically its nozzle 57 from deposits since the fuel injector nozzle will be shielded both by the throttle valve 49 and its recess into the port 58 of the throttle body 25. This will insure that carbon deposits and other build ups will not occur that will disrupt the flow of fuel from the sub injector 27 when it is actuated.

Referring now in detail to FIG. 7, the fuel injector system is disclosed in more detail as is the circuitry associated with it. Fuel is delivered from a fuel tank 61 to the air fuel injectors 39 from a pressure pump 62 through a conduit 63 that supplies the fuel to the fuel rail 43. This fuel is then supplied to a regulator 64 that regulates the fuel pressure for the injectors 39 and specifically the fuel injectors 42 thereof. The regulator 64 discharges into a line 65 which communicates with the port 55, as aforenoted, with the port 56 communicating with a second pressure regulator 66. The pressure regulator 66 sets the pressure of fuel delivered to the sub injectors 27 by bypassing return flow through a line 67 back to the tank 61.

Air under pressure is supplied to the air fuel injectors 39 and specifically the air manifold 44 from an air compressor 68 through a line 69. The regulator for air pressure is contained within the air fuel pressure regulator 64 and excess air pressure is relieved by venting the excess air through a line 71 to a suitable discharge, such as directly to the exhaust manifold 38.

The system for controlling the fuel air pressure and the discharge of fuel from both the injector 39 and air from this injector and fuel from the sub injector 27 includes a CPU 72 that is preprogrammed according to one of a plurality of sequences, as to be described. The CPU outputs a signal c to the fuel injector 42 of the injection unit 39 so as to control the timing and duration of fuel flow and also outputs a signal d to the injector 39 to control the timing and duration of opening and closing of the injection valve. The CPU also outputs a signal e to the auxiliary or sub fuel injection 27 so as to control its discharge in accordance with a strategy to be described. A pressure differential sensor 73 outputs a signal f back to the CPU 72 which indicates the pressure difference between the fuel and air in the injectors 39. In addition, the CPU receives a number of engine running parameters, indicated by the arrow J, which will include the position of the throttle valves 49 determined by the potentiometer 26 and also the air flow through the system as determined by the sensor 53.

Figure 8:
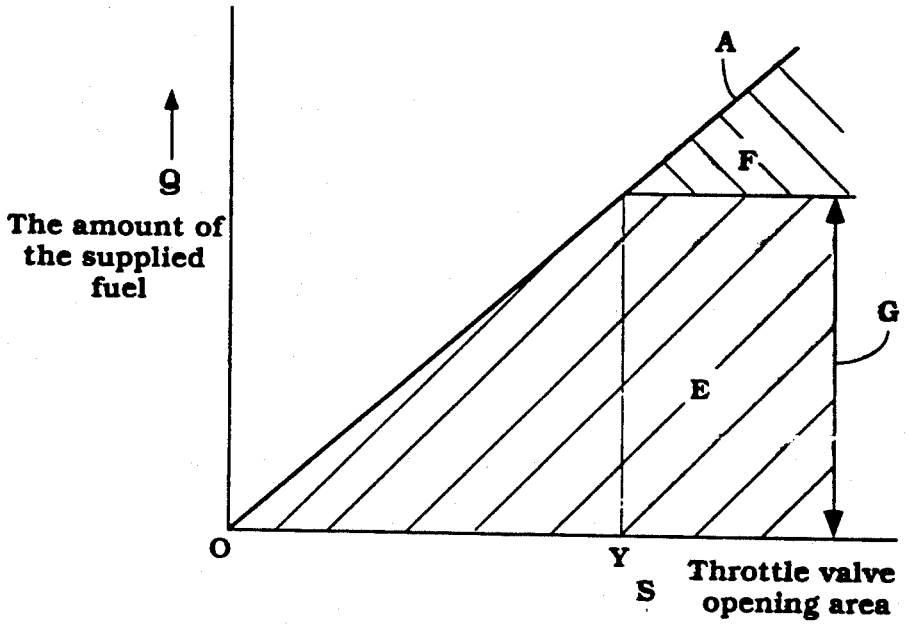
FIG. 8 is a graphic view showing the amount of fuel supplied in relation to throttle opening between the main and sub injector.
Figure 9:
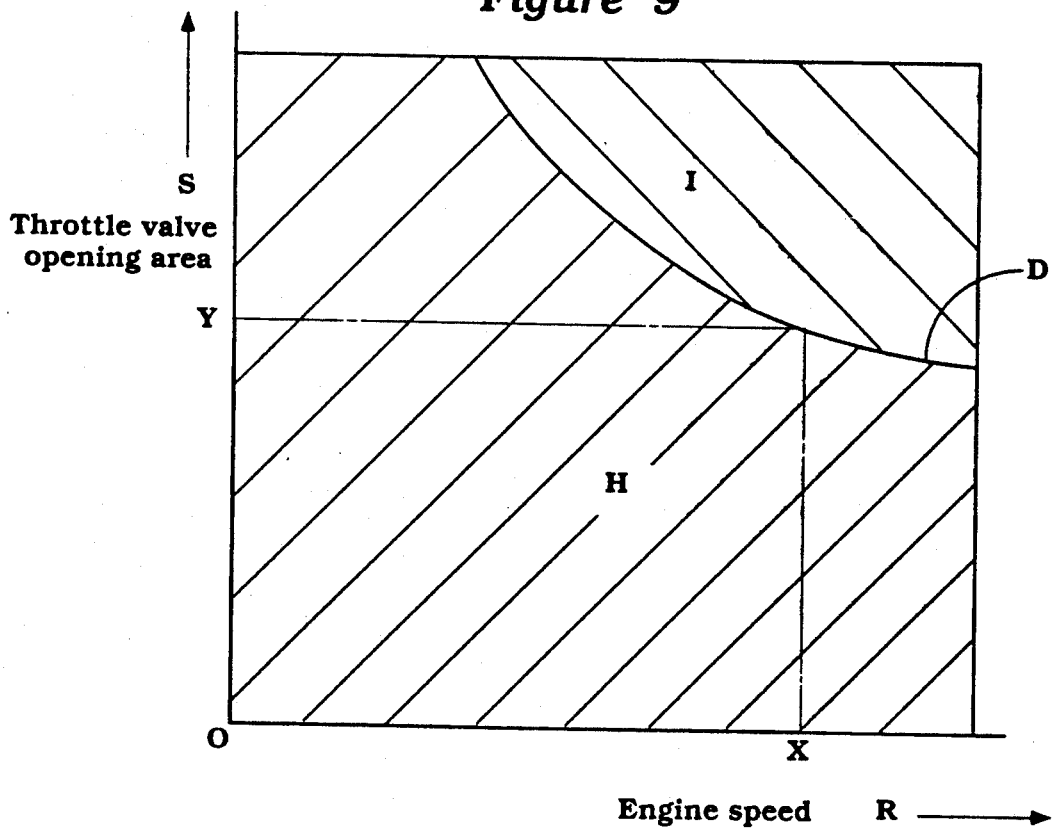
FIG. 9 is a graphic view showing the relationship of throttle valve opening and engine speed to the amount of fuel delivery from the main and sub injectors.
Figure 10:
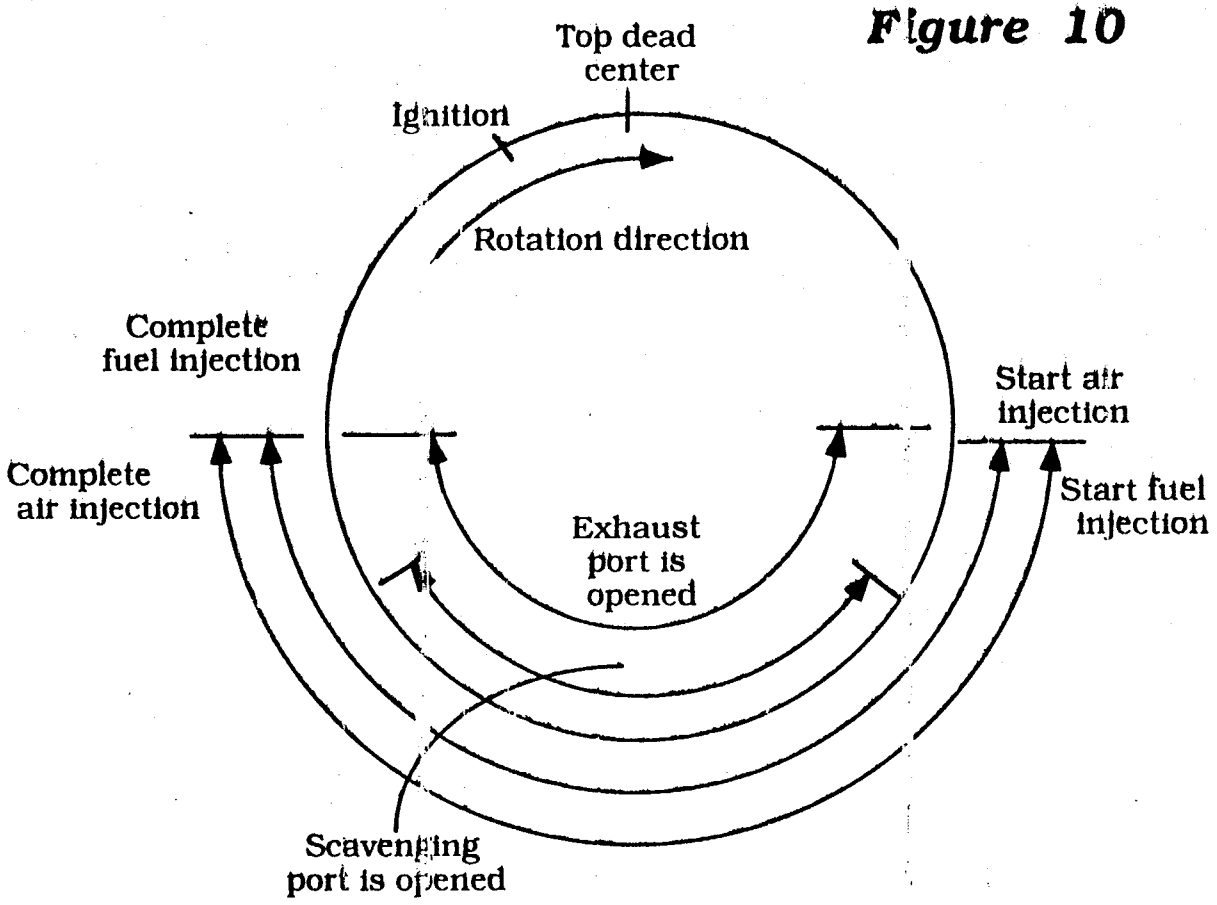
FIG. 10 is a graphic view showing the injection timing of the main injection system.

Although the specific strategy by which the sub fuel injector 27 is operated relative to the main injector 39 may be varied, one particular strategy is depicted in FIGS. 8 through 10. In this particular strategy, it is recognized that there may be a practical limit to the quantity of fuel which may be injected by the main injector 39 while still maintaining good control for the fuel delivery under low speeds. With this particular strategy, the main fuel injector 39 supplies the fuel requirements of the engine up to a specific load. Beyond this condition, then the main fuel injector 39 has its fuel delivery saturated and maintained at the maximum level while the quantity of fuel injected by the sub injector 27 is varied. As may be seen in FIG. 8, in order to maintain a given speed of the engine as the load increases, the throttle area continues to open up until the point Y at which time the main fuel injection amount indicated by the shaded portion of the curve E, which is a maximum, as indicated by the dimension G, are reached. After this point, the sub injector 27 begins to discharge along the curve A to deliver fuel indicated by the shaded portion F so that the engine speed may be maintained constant regardless of load u to the maximum load capabilities of the engine.

FIG. 9 is a graphic view showing the range I in which the sub injector is operated relative to the range H of the main injector for variations in engine speed with respect to throttle opening. The point Y is depicted at this curve for the engine speed X of the embodiment shown in FIG. 8.

FIG. 10 is a timing diagram showing the timing operation of the main injector 39. It should be noted that both air and fuel injection are begun at a point after the exhaust port is opened, but before the point when the scavenging port is closed. The air and fuel injection is completed after the scavenging port is closed and approximately at the same time when the exhaust port closes. Of course, various arrangements may be employed.

In the illustrated embodiment, the sub injector 27 is disposed so that approximately one half of its fuel discharge will impinge upon the throttle valve 49 at full throttle and the remaining half will impinge upon the throttle body surface 46. Of course, various arrangements may be employed on a given engine. However, the described embodiment is particularly effective in providing equal delivery to all cylinders. Also, it should be noted that the fuel is sprayed on the closed or closing side of the throttle valve 49 as this has been found to improve throttle valve return response and engine control.

It should be readily apparent from the foregoing description that the described embodiments of the invention are particularly adapted in providing good cooling of the components of the engine through the use of a sub injector while, at the same time, insuring good mixture distribution and avoiding clogging of the sub injection nozzle due to the formation of deposits or the like. Of course, the foregoing description is only that of preferred embodiments of the invention. Various changes and modifications may be made without departing from the spirit and scope of the invention, as defined by the appended claims.

We claim:

1. A fuel injection system for a two cycle crankcase compression internal combustion engine comprising a combustion chamber, a first fuel injector for injecting fuel under greater than atmospheric pressure directly into said combustion chamber, a crankcase chamber, transfer port means for transferring a charge from said crankcase chamber to said combustion chamber, induction means for delivering a charge to said crankcase chamber, throttle valve means for controlling the flow through said induction means, and a second fuel injector for injected fuel under greater than atmospheric pressure against said throttle valve means in at least some positions of said throttle valve means, wherein the first fuel injector supplies fuel to the engine under at least certain running conditions and the second fuel injector supplies fuel to the engine only under some of said certain running conditions.

2. A fuel injector system as set forth in claim 1 wherein the second fuel injector only supplies fuel to the engine when the throttle valve means is in the at least some positions.

3. A fuel injection system as set forth in claim 2 wherein the second fuel injector injects fuel to the induction means upstream of the throttle valve means.

4. A fuel injection system as set forth in claim 3 wherein the engine is a spark ignited internal combustion engine.

5. A fuel injection system as set forth in claim 4 wherein the first fuel injector supplies fuel under all running conditions and a maximum amount of fuel that is less than the maximum amount of fuel required by the engine at maximum load condition and wherein the second fuel injector supplies the additional fuel required for maximum load condition.

6. A fuel injection system as set forth in claim 1 wherein the engine has multiple combustion chambers and multiple crankcase chambers, each associated with a respective one of the combustion chambers through respective transfer port means and wherein there are provided a plurality of first fuel injectors, one for each of the combustion chambers.

7. A fuel injection system as set forth in claim 6 further including a single throttle body and a single throttle valve for supplying the charge to each of the crankcase chambers through a respective manifold runner whereby the second fuel injector supplies fuel for each of the crankcase chambers.

8. A fuel injection system as set forth in claim 7 wherein the first fuel injector supplies fuel to the engine under all running conditions and the second fuel injector supplies fuel to the engine only under certain running conditions.

9. A fuel injection system as set forth in claim 8 wherein the second fuel injector only supplies fuel to the engine when the throttle valve means is in the at least some positions.

10. A fuel injection system as set forth in claim 9 wherein the second fuel injector injects fuel to the induction means upstream of the throttle valve means.

11. A fuel injection system as set forth in claim 10 wherein the engine is a spark ignited internal combustion engine.

12. A fuel injection system as set forth in claim 11 wherein the first fuel injector supplies a maximum amount of fuel that is less than the maximum amount of fuel required by the engine at maximum load condition and wherein the second fuel injector supplies the additional fuel required for maximum load condition.

13. A fuel injection system for a two cycle crankcase compression internal combustion engine comprising a combustion chamber, a first fuel injector for spraying fuel under greater then atmospheric pressure directly into said combustion chamber, a crankcase chamber, transfer port means for transferring a charge from said crankcase chamber to said combustion chamber, induction means for delivering a charge to said crankcase chamber, throttle valve mean for controlling the flow through said induction means, and a second fuel injector for injected fuel under greater than atmospheric pressure into said induction means upstream of said throttle valve in at least some positions of said throttle valve, wherein the first fuel injector supplies fuel to the engine under at least certain running conditions and the second fuel injector supplies fuel to the engine only under some of said certain running conditions 14. A fuel injection system as set forth in claim 13 wherein the engine is a spark ignited internal combustion engine.

15. A fuel injection system a set forth in claim 14 wherein the first fuel injector supplies fuel under all running conditions and a maximum amount of fuel that is less than the maximum amount of fuel required by the engine at maximum load condition and wherein the second fuel injector supplies the additional fuel required for maximum load condition.

16. A fuel injection system as set forth in claim 13 wherein the engine has multiple combustion chambers and multiple crankcase chambers, each associated with a respective one of the combustion chambers through respective transfer port means and wherein there are provided a plurality of first fuel injectors, one for each of the combustion chambers.

17. A fuel injection system as set forth in claim 16 further including a single throttle body and a single throttle valve for supplying the charge to each of the crankcase chambers through a respective manifold runner whereby the second fuel injector supplies fuel for each of the crankcase chambers.

18. A fuel injection system as set forth in claim 17 wherein the first fuel injector supplies fuel to the engine under all running conditions and the second fuel injector supplies fuel to the engine only under certain running conditions.

19. A fuel injection system as set forth in claim 18 wherein the engine is a spark ignited internal combustion engine.

20. A fuel injection system as set forth in claim 19 wherein the first fuel injector supplies a maximum amount of fuel that is less than the maximum amount of fuel required by the engine at maximum load condition and wherein the second fuel injector supplies the additional fuel required for maximum load condition.

21. A fuel injection system for a two cycle crankcase compression internal combustion engine comprising a combustion chamber, a first fuel injector for injecting fuel directly into said combustion chamber, a crankcase chamber, transfer port means for transferring a charge from said crankcase chamber to said combustion chamber, induction means for delivering a charge to said crankcase chamber, control valve means for controlling the flow through said induction means, and a second fuel injector for injecting fuel against said control valve means in at least some positions of said control valve means, said first fuel injector supplying fuel to said engine under at least certain running conditions and said second fuel injector supplies fuel to the engine only under some of said certain running conditions.

22. A fuel injection system as set forth in claim 21 wherein the second fuel injector only supplies fuel to the engine when the control valve means is in the at least some positions.

23. A fuel injection system as set forth in claim 22 wherein the second fuel injector injects fuel to the induction means upstream of the control valve means.

24. A fuel injection system as set forth in claim 23 wherein the engine is a spark ignite internal combustion engine.

25. A fuel injection system as set forth in claim 24 wherein the first fuel injector supplies fuel under all running conditions and a maximum amount of fuel that is less than the maximum amount of fuel required by the engine at maximum load condition and wherein the second fuel injector supplies the additional fuel required for maximum load condition.

26. A fuel injection system as set forth in claim 21 wherein the engine has multiple combustion chambers and multiple crankcase chambers, each associated with a respective one of the combustion chamber through respective transfer port means and wherein there are provided a plurality of first fuel injectors, one for each of the combustion chambers.

27. A fuel injections system as set forth in claim 26 wherein the control valve is a throttle valve and further including a single throttle body and a single throttle valve for supplying the charge to each of the crankcase chambers through a respective manifold running whereby the second fuel injector supplies fuel for each of the crankcase chambers.

28. A fuel injection system as set forth in claim 27 wherein the first fuel injector supplies furl to the engine under at least certain running conditions and the second fuel injector supplies fuel to the engine only under some of said certain running conditions.

29. A fuel injection system a set forth in claim 28 wherein the second fuel injector only supplies fuel to the engine when the throttle valve means is in the at least some conditions.

30. A fuel injection system as set forth in claim 29 wherein the second fuel injector injects fuel to the induction means upstream of the throttle valve means.

31. A fuel injection system as set forth in claim 30 wherein the engine is a spark ignited internal combustion engine.

32. A fuel injection system as set forth in claim 31 wherein the first fuel injector supplies fuel under all running conditions and a maximum amount of fuel that is less than the maximum amount of fuel required by the engine at maximum load condition and wherein the second fuel injector supplies the additional fuel required for maximum load condition.

33. A fuel injection system for a two cycle crankcase compression internal combustion engine comprising a combustion chamber, a first fuel injector for injecting fuel directly into said combustion chamber, a crankcase chamber, transfer port means for transferring a charge from said crankcase chamber to said combustion chamber, induction means for delivering a charge to said crankcase chamber, control valve means for controlling the flow through said induction means, and a second fuel injector for injecting fuel into said conduction means upstream of said control valve means in at least some positions of said control valve means, said first fuel injector supplying fuel to said engine under at least certain running conditions and said second fuel injector supplies fuel to the engine only under some of said certain running conditions.

34. A fuel injection system as set forth in claim 33 wherein the engine is a spark ignited internal combustion engine.

35. A fuel injection system as set forth in claim 34 wherein the first fuel injector supplies fuel under all running conditions and a maximum amount of fuel that is less than the maximum amount of fuel required by the engine at maximum load condition and wherein the second fuel injector supplies the additional fuel required for maximum load condition.

36. A fuel injection system as set forth in claim 33 wherein the engine has multiple combustion chambers and multiple crankcase chambers, each associated with a respective one of the combustion chamber through respective transfer port means and wherein there are provided a plurality of first fuel injectors, one for each of the combustion chambers.

37. A fuel injection system as set forth in claim 36 wherein the control valve means comprises a throttle valve and further including a single throttle body and a single throttle valve for supplying the charge to each of the crankcase chambers through a respective manifold running whereby the second fuel injector supplies fuel for each of the crankcase chambers.

38. A fuel injection system as set forth in claim 37 wherein the first fuel injector supplies fuel to the engine under at least certain running conditions and the second fuel injector supplies fuel to the engine only under some of said certain running conditions.

39. A fuel injection system as set forth in claim 38 wherein the engine is a spark ignited internal combustion engine.

40. A fuel injection system as set forth in claim 39 wherein the first fuel injector supplies fuel under all running conditions and a maximum amount of fuel that is less than the maximum amount of fuel required by the engine at maximum load condition and wherein the second fuel injector supplies the additional fuel required for maximum load condition.

* * * * *